US005152242A

United States Patent [19]

Bradley

[11] Patent Number: 5,152,242

[45] Date of Patent: Oct. 6, 1992

[54] PROTECTIVE HULL ENCLOSURE

[76] Inventor: William A. Bradley, 1636 S. Brookhurst St., Anaheim, Calif. 92804

[21] Appl. No.: 701,773

[22] Filed: May 17, 1991

[51] Int. Cl.[5] ..... B63B 59/00

[52] U.S. Cl. ..... 114/222; 405/64

[58] Field of Search ..... 114/44, 45, 54, 222, 114/230; 405/63-66, 68

[56] References Cited

U.S. PATENT DOCUMENTS

| | | | |
|---|---|---|---|
| 3,685,477 | 8/1972 | Wood | 114/222 |
| 4,026,233 | 5/1977 | Cox | 114/229 |
| 4,046,094 | 8/1977 | Preiser et al. | 114/222 |
| 4,215,644 | 8/1980 | Jackson | 114/222 |
| 4,280,438 | 7/1981 | Jackson | 114/222 |
| 4,280,439 | 7/1981 | Jackson | 114/222 |
| 4,421,436 | 12/1983 | Burns | 405/60 |
| 4,693,200 | 9/1987 | Noble | 114/47 |
| 4,909,172 | 3/1990 | Hambley | 114/219 |

*Primary Examiner*—Jesûs D. Sotelo

[57] ABSTRACT

A protective hull enclosure for a stationary boat floating in a body of water is disclosed. A floatation collar forms a first closed figure that approximates the shape of the perimeter of the hull at the surface of the water. The interior of this floatation collar forms a continuous open space. A shroud frame is formed of a continuous flexible rod, and forms a second closed figure also approximating the shape of the perimeter of the hull. A protective shroud of a flexible, water impenetrable, opaque material in the approximate shape of the hull of the boat has a hem formed therein into which the shroud frame is inserted and retained. The shroud and shroud frame are attached to the floatation collar. The shroud also includes pockets sewn into the material and support ballast weights. A continuous flap protrudes from the hem of the shroud toward the side of the hull and extends around the perimeter of the boat, thereby providing a means for preventing light from entering the water between the hem of the shroud and the side of the boat. A gas pump is provided that forces water from the floatation collar to be forced through a U-shaped water inlet tube at the low point in the floatation collar, causing the floatation collar to be filled with air and float, thereby causing the hull enclosure to achieve a deployed position. A venturi pump is included that pulls water through the inlet tube into the floatation collar, causing the floatation collar to sink and thereby causing the hull enclosure to achieve an undeployed position, allowing the boat to depart. A guide apparatus is included that has at least one slidable connector fixed to the collar, and at least one guide wire that is held by a wire support in a vertical orientation adjacent to the collar and independent of the boat.

6 Claims, 4 Drawing Sheets

PROTECTIVE HULL ENCLOSURE

FIELD OF THE INVENTION

This invention relates generally to anti-fouling devices for boat hulls. More specifically, this invention relates to a selectively engaging boat hull antifouling device.

BACKGROUND OF THE INVENTION

It has long been established that unprotected boat hulls, when left submerged for periods of time in a body of water, are susceptible to damage through fouling by various marine organisms. A number of inventions have been devised to reduce this damage. For example, many types of permanent hull coatings have been used that act as a physical barrier between a boat's hull and the water immediately surrounding it. Such coatings, however, typically do not protect the hull from the accumulation of barnacles and algae. In some cases, such coatings also reduce performance of the vessel due to the weight of the coatings. Other coatings use a toxic substance to retard fouling by marine life, but significant environmental drawbacks exist with the use of such toxic coatings, and, consequently, such coatings are becoming less practical.

Other devices are available that serve to protect a boat hull only while the boat is at rest, since marine life is not able to afflict damage to the boat's hull when the boat is moving. As such, these types of devices have generally taken the form of stationary, submergible enclosures that are caused to engage a boat's hull after the boat has entered its mooring. Typically, such devices will form an opaque shroud around the submerged portions of the boat's hull to form an enclosure. The opaque shroud prevents sunlight from entering the water between the shroud and the hull, thus limiting organism growth and thereby reducing its damaging effects. Toxic additives are used to kill marine life within the enclosure. Yet another approached is to pump fresh water into the enclosure, thereby killing any marine life that depends upon sea water to survive. All of these enclosure devices have a common drawback in that they are extremely difficult to operate and maintain, often requiring a person to enter the water surrounding the vessel to secure the enclosure to the hull of the boat. Such enclosure devices typically provide a variety of pumps and operating equipment, complicated dock-side attachment means, and complex guide means for the enclosure. Not only does the complexity of such devices make installation relatively difficult, but it affects the ease with which such devices are operated and maintained. As such, widespread use of enclosure devices has not been developed.

Thus, there is a clear need for a hull protection device that significantly reduces the fouling marine life damage of boat hulls and that is also relatively simple to install, operate, and maintain. Such a needed device should be capable of adaptation to a variety of boat hulls, environmentally acceptable, and relatively inexpensive. The present invention fulfills these needs and provides further related advantages.

SUMMARY OF THE INVENTION

The present invention is a protective hull enclosure for a stationary boat floating in a body of water, the surface of the water defining a water-line on the hull of the boat. A floatation collar formed of a continuous watertight tube forms a first closed figure that approximates the shape of the perimeter of the hull at the waterline. The interior of this floatation collar forms a continuous empty space.

A shroud frame is formed of a continuous flexible rod, and forms a second closed figure also approximating the shape of the perimeter of the hull at the waterline. A protective shroud of a flexible, water impenetrable, opaque material in the approximate shape of the hull of the boat has a hem formed therein into which the shroud frame is inserted and retained. The shroud and shroud frame include attachment means to the flotation collar. Preferably, the shroud also includes pockets sewn into the material and support ballast weights. Also included with the shroud is a continuous flap protruding from the hem of the shroud toward the side of the boat and extending around the perimeter of the boat, thereby providing a means for preventing light from entering the water between the hem of the shroud and the side of the boat.

A means for flooding and a means for emptying the floatation collar with water is provided that, when emptying the floatation collar of water and replacing it with air, cause the flotation collar to float and, when filling the floatation collar with water, cause the flotation collar to sink. Preferably, a water inlet device is included to facilitate flooding and emptying the flotation collar.

A guide apparatus is preferably included that has at least one means of slidable connection fixed to the collar, and at least one guide wire that is held by a wire support means in a vertical orientation adjacent to the collar and independent of the boat.

In operation, the shroud being in an undeployed, sunken position, a boat is positioned over the hull enclosure, such as when at dock or at anchor. The means for emptying, such as an air pump, is activated, thereby filling the floatation collar with air while driving the water out of the collar, and causing it to rise with the shroud while being guided by the guide wires. Water between the shroud and the hull is expelled by this process, thereby eliminating the need for a water pump to remove this water. As the shroud encloses the hull of the boat, the flotation collar rises to the surface of the water where it rests in close proximity to the hull, the continuous flaps coming to rest in contact with the hull and forming an opaque seal around the hull. The hull enclosure is now in a fully deployed position, with some water remaining between the shroud and the hull. With the hull enclosure fully deployed, the hull is protected from fouling by marine life since such marine life will soon perish due to lack of sunlight. There is no need for chemicals, such as chlorine, to be introduced between the hull and the shroud to eliminate fouling marine life within the enclosure.

At some later time, when the boat is set to depart, the means for flooding is activated, thereby filling the floatation collar with water. When the floatation collar is sufficiently filled with water, it will no longer be buoyant enough to float and so will slowly sink, being guided to the sea bottom by the guide wires. The boat is then be ready to depart.

This device succeeds in protecting the hull of a boat against fouling marine life while the boat is stationary and while the device is in the deployed position. Installation of the device comprises the positioning of guide wires attached between an anchor and some suitable nearby structure, such as a dock or buoy; the proper shaping of the floatation collar, shroud frame, and shroud; and installation. Operation of the device requires proper positioning of the boat and activation of the means for filling and means for emptying of the floatation collar. Such means for filling and means for emptying of the floatation collar can be installed either on a dock adjacent to the hull enclosure, or aboard the boat itself with minimal additional equipment. It is not necessary, with this device, to manually position or attach the continuous flap around the perimeter of the hull, nor is it necessary to detach the flap when undeploying the protective enclosure. Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENT

Figure 1:
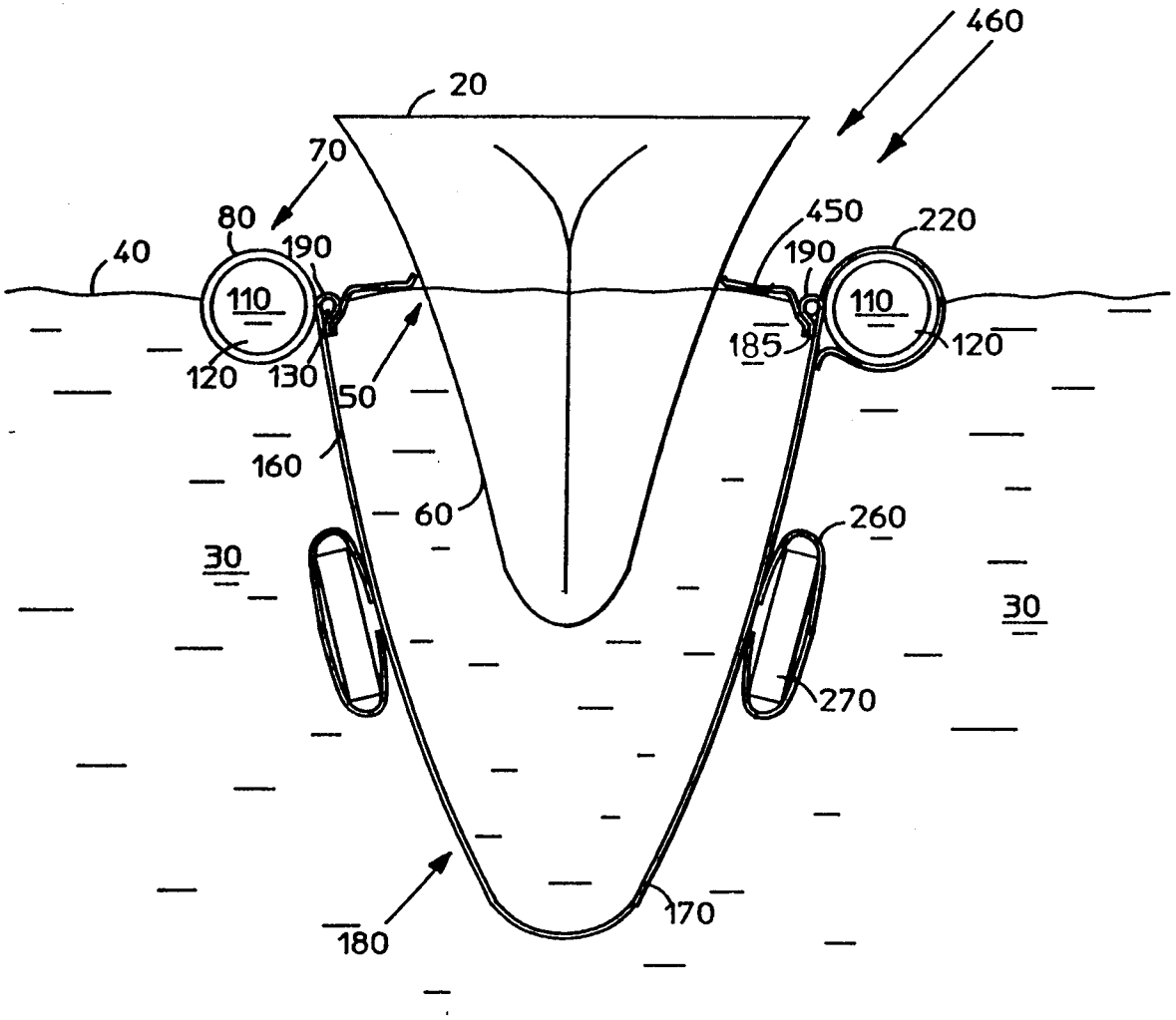
FIG. 1 is a cross section front elevational view of the invention, illustrating a hull and a protective enclosure of the invention deployed therearound.

FIG. 1 shows a protective hull enclosure 10 for a boat 20 floating in water 30. The surface 40 of the water 30 defines a water-line 50 on the hull 60 of the boat 20. A floatation collar 70 is a continuous watertight tube 80 forming a first closed figure which approximates the conformation of the water line 50 against the hull 60.

A shroud frame 130 is formed from flexible rod stock into a second closed figure which also approximates the conformation of the water line 50 against the hull 60.

A shroud edge 185 is formed into a hem 190, the shroud edge 185 forming a third closed figure, again approximating the conformation of the water line 50.

The shroud frame 130 is inserted and retained within the hem 190. Preferably, pockets 260 are sewn onto the shroud 160 wherein ballast weights 270 are retained, whereby the shroud 160 maintains the preferred shape 180 as the shroud 160 is moved upward or downward in the water 30. Also in the preferred mode of the invention, the shroud 160 includes a continuous flap 450 protruding form the hem 190 to the hull 60 and extends around the hull 60 at the water-line 50. This flap 450 prevents light 460 from entering the water 30 between the hem 190 of the shroud 160 and the hull 60, thereby preventing the growth of water borne life forms (not shown) that require light to grow.

Figure 2:
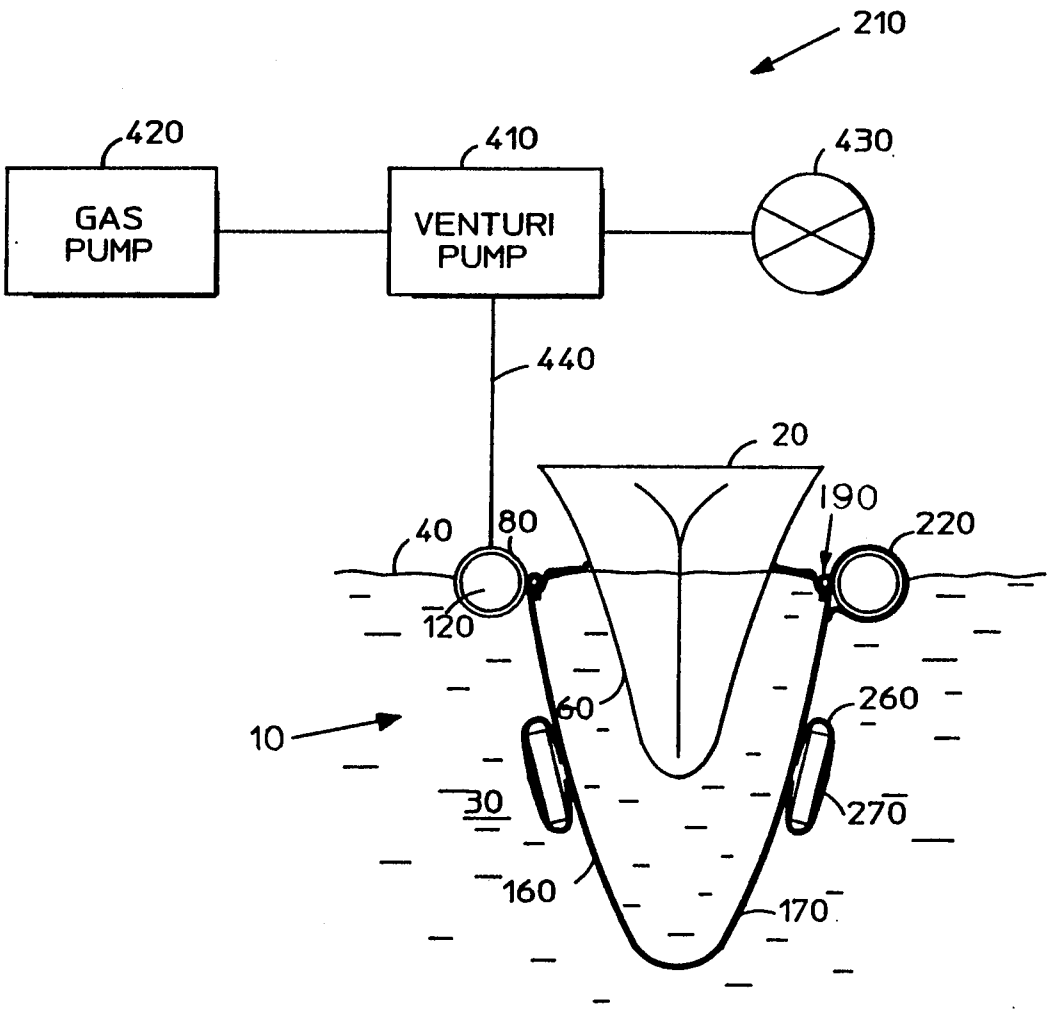
FIG. 2 is a schematic block diagram of the interconnections between components of a means for filling and means for emptying of a floatation collar of the invention of FIG. 1.

A flooding and emptying means 210 of the floatation collar 70 is provided (FIG. 2), preferably including a gas pump 420 for moving water 30 out of the collar 70, a venturi pump 410 for creating suction for moving water 30 into the collar 70, a gas valve 430 for switching between the gas pump 420 and the venturi pump 410, and a hose 440 for connecting the gas pump 420 and the venturi pump 410 to the collar 70. Also in the preferred mode of the invention, a water inlet device 280, formed from an inverted U-shaped tube, has a first parallel leg 300 and a second parallel leg 310, and a horizontal base 320. The base 320 is positioned above the highest point 330 of the collar 70. One end of the first leg 300 is interconnected to the collar 70 at the lowest point 340 in the collar 70. The water inlet device 280 prevents water 30 from entering the collar 70 unless the venturi pump 410 is active. The water inlet device 280 also allows water 30 to escape the collar 70 when the gas pump 420 is active.

A fastening means 220 is included for fastening the shroud 160 to the floatation collar 70. In the preferred mode of the invention, a guide apparatus 360 is included with at least one slidable connection means 370 and at least one guide wire 380. Each slidable connection means 370 is fixed to the floatation collar 70 and slidably engages one guide wire 380. Each guide wire 370 is fixed to a wire support means 390 in a generally vertical orientation adjacent to the collar 70 and independent of the boat 20 so that the collar 70 is vertically guided when the collar 70 moves up or down in the water 30.

Figure 3B:
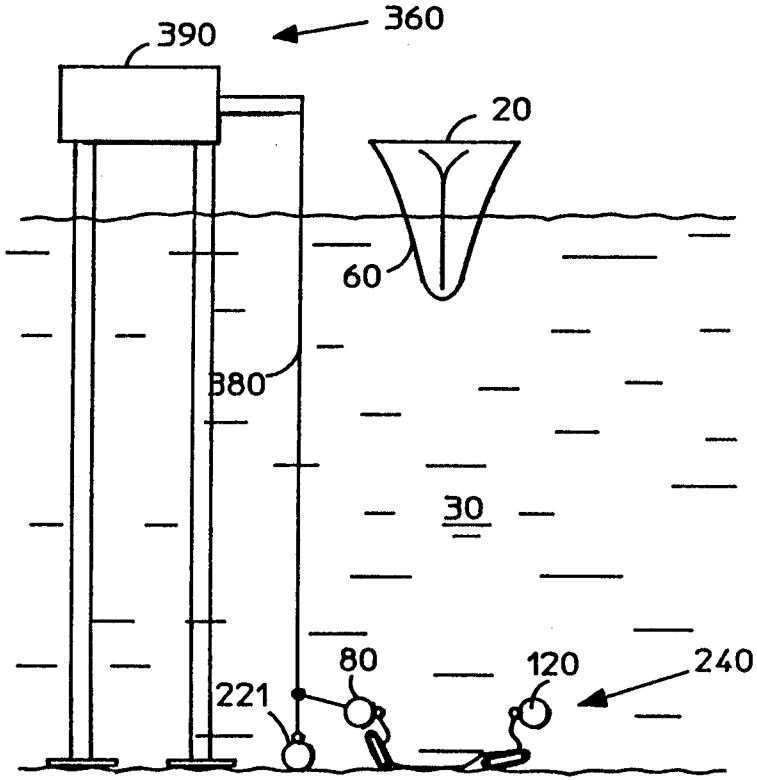
FIG. 3B is an expanded cross section front elevational view of the invention of FIG. 1, further showing the guide wire and dock installation of the invention, the protective enclosure of the invention being in an undeployed position.
Figure 3A:
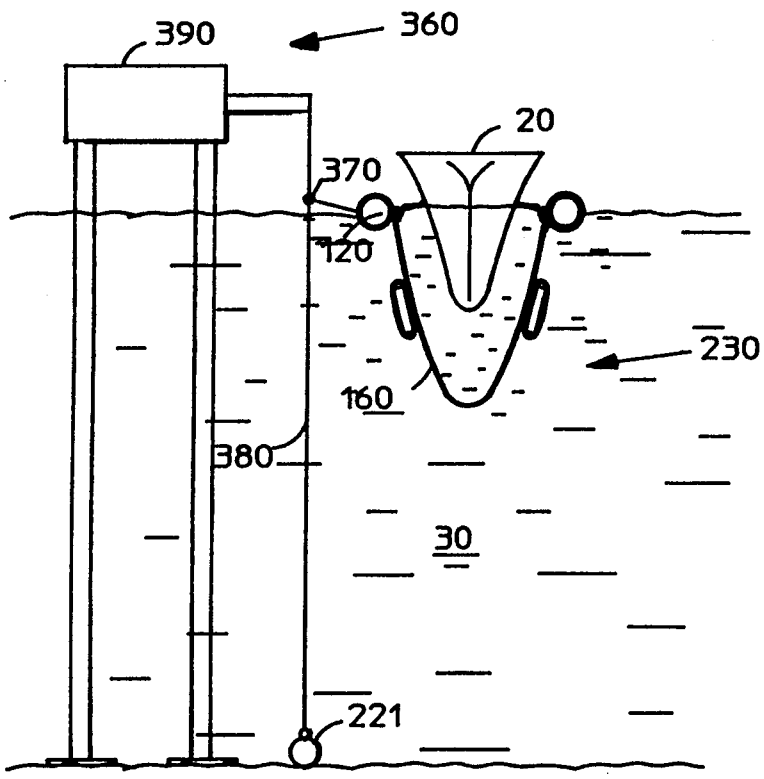
FIG. 3A is an expanded cross section front elevational view of the invention of FIG. 1, further showing a guide wire and dock installation of the invention, the protective enclosure of the invention being in a deployed position.
Figure 4:
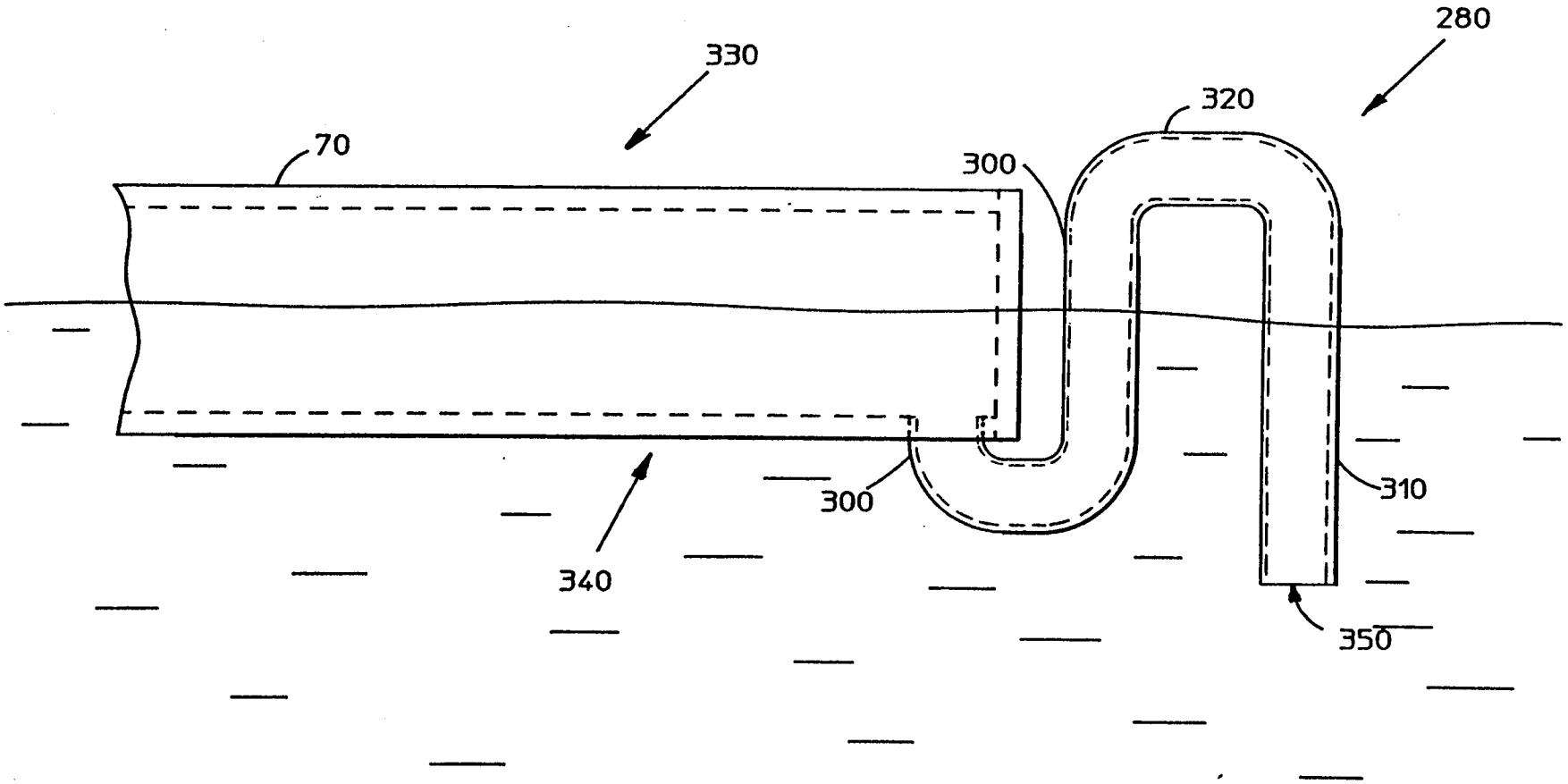
FIG. 4 is a partial left side elevational view of a syphon device of the invention, the syphon device connected to a lowest end of a floatation collar of the invention.

In operation, the protective hull enclosure 10 may be placed in a first deployed position 230 (FIG. 3A), with the collar 70 devoid of water 30, the shroud 160 fitting around the hull 60 and the collar 70 floating in a position encircling the ship 20 at the water-line 50. In this deployed position 230 the protective hull enclosure 10 provides protection to the hull 60 of the ship 20 by preventing light 460 from entering the water 30 between the hull 60 and the shroud 160, thereby killing water borne life forms (not shown) that require light 460 to live, and by preventing other water borne life forms (not shown) from reaching the hull 60. When the ship 20 is set to leave, the collar 70 is flooded with water 30 by activating the flooding and emptying means 210, consequently submerging the protective hull enclosure 10 to a level below the hull 60 of the ship 20 and thereby permitting the ship 20 to move away from the protective hull enclosure 10.

While the invention has been described with reference to a preferred embodiment, it is to be clearly understood by those skilled in the art that the invention is not limited thereto. Rather, the scope of the invention is to be interpreted only in conjunction with the appended claims.

What is claimed is:

1. A protective hull enclosure for a boat floating in water, the surface of the water defining a water-line on the hull of the boat, comprising:

a floatation collar, the collar being a continuous watertight tube forming a first closed figure, the shape of the figure approximating the shape of the perimeter of the boat at the water-line, the interior of the tube defining an open space;

a shroud frame, the frame being a continuous flexible rod forming a second closed figure, the shape of the figure approximating the shape of the perimeter of the boat at the water-line;

a protective shroud of a flexible, water impenetrable material, the shroud having a shape approximating the shape of the hull of the boat below the water-line, and a shroud edge formed into a hem, the shroud edge forming a third closed figure, the shape of the figure approximating the shape of the perimeter of the boat at the water-line, the shroud frame being inserted and captured within the hem;

a means for flooding and emptying the floatation collar; and a means for fastening the shroud to the floatation collar, the shroud being attached to the floatation collar by the fastening means; whereby the protective hull enclosure may be placed in a first deployed position, with the collar devoid of water, where the shroud is fitted around the hull, the floatation collar floating in a position encircling the ship at the water-line, thereby providing protection to the hull of the ship, or in a second undeployed position, the collar being flooded, where the collar and the shroud are submerged to a level below the hull of the ship thereby permitting the ship to move away from the protective hull enclosure.

2. The hull enclosure of claim 1 wherein the shroud has pockets sewn into the fabric, the pockets for accepting ballast weights for preventing the shroud from billowing upward when the collar is moved to the undeployed position.

3. The hull enclosure of claim 1 further including a water inlet device, the device being an inverted "U" shaped tube having a first and a second vertical parallel legs and a horizontal base, the base being positioned above the highest point of the collar, the end of the first leg being interconnected to the collar at the lowest point in the collar, the end of the second leg being open and extending below the surface of the water.

4. The hull enclosure of claim 1 further including a guide apparatus including at least one means for slidable connection, at least one guide wire, and a means for wire support, the connection means being fixed to the collar and to the at least one guide wire, the wire being held by the means for wire support in a vertical orientation adjacent to the collar so that the collar is vertically guided when the collar moves between the deployed and the undeployed positions.

5. The hull enclosure of claim 1 wherein the means for flooding and emptying the floatation collar includes a pump system having a gas pump for moving water out of the collar, a venturi pump for creating suction for moving water into the collar, a gas valve for switching between the gas pump and the venturi pump, and a hose for connecting the gas pump and the venturi pump to the collar.

6. The hull enclosure of claim 1 wherein the protective shroud has a continuous flap protruding from the hem to the side of the boat and extending around the perimeter of the boat, the flap providing a means for preventing light from entering the water between the hem of the shroud and the side of the boat, in order to prevent the growth of water borne life forms that require light, the flap being of a size and shape to naturally cover the water between the hem and the shroud.

* * * * *